United States Patent [19]

Knapp et al.

[11] 3,974,813

[45] Aug. 17, 1976

[54] FUEL METERING SYSTEM FOR INTERNAL COMBUSTION ENGINES

[75] Inventors: Heinrich Knapp, Leonberg-Silberberg; Johannes Brettschneider, Ludwigsburg-Pflugfelden; Lorenz Bundesen, Flensburg, all of Germany

[73] Assignee: Robert Bosch G.m.b.H., Stuttgart, Germany

[22] Filed: Aug. 29, 1973

[21] Appl. No.: 392,659

[30] Foreign Application Priority Data

Aug. 29, 1972 Germany ..... 2242345
Aug. 1, 1973 Germany ..... 2338875

[52] U.S. Cl. ..... 123/140 MC; 261/50 A; 261/DIG. 67

[51] Int. Cl.[2] ..... F02D 1/04

[58] Field of Search ..... 123/140 MC, 140 MP, 123/140 R; 261/72, 44 R, DIG. 67, 50 A

[56] References Cited

UNITED STATES PATENTS

| | | | |
|---|---|---|---|
| 2,895,465 | 7/1959 | Humber et al. | 123/140 R |
| 3,198,498 | 8/1965 | Mennesson | 261/50 A |
| 3,285,585 | 11/1966 | Mennesson | 261/50 A |
| 3,307,837 | 3/1967 | Winkler | 261/DIG. 67 |
| 3,689,036 | 9/1972 | Kikuchi et al. | 123/127 |
| 3,730,157 | 5/1973 | Gerhold | 261/DIG. 67 |
| 3,738,341 | 6/1973 | Loos | 123/140 MC |
| 3,745,768 | 7/1973 | Zecanall et al. | 123/140 MC |

FOREIGN PATENTS OR APPLICATIONS

| | | | |
|---|---|---|---|
| 1,281,748 | 8/1968 | Germany | 261/DIG. 67 |

*Primary Examiner*—Charles J. Myhre
*Assistant Examiner*—Paul Devinsky
*Attorney, Agent, or Firm*—Edwin E. Greigg

[57] ABSTRACT

A fuel-metering system adapted for attachment to an air-intake suction tube, having a throttle passage therein, of an internal combustion engine having an exhaust for waste gases, which system comprises:

a. a fuel reservoir having an airspace above the fuel therein, b. structure for measuring the air pressures in the airspace and the suction tube and for metering fuel amounts to be introduced into given amounts of air flowing through the suction tube, in dependence on the air pressures, and c. structure for varying the air pressures prevailing in the airspace, in dependence on characteristic engine data, which air pressure-varying structure comprises first and second conduit structures for connecting the said airspace with the suction tube upstream and downstream, respectively, of the throttle passage, an output signal-emitting measuring probe for detecting the composition of the exhaust gas of the internal combustion engine, and valve components for controlling the cross-sectional area of the aforesaid conduit structures in dependence on output signals emitted by the measuring probe.

20 Claims, 7 Drawing Figures

FUEL METERING SYSTEM FOR INTERNAL COMBUSTION ENGINES

BACKGROUND OF THE INVENTION

This invention relates to a fuel-metering system for internal combustion engines, which system comprises a fuel reservoir and a fuel line leading from the said reservoir to a suction tube for the intake of air, and wherein the amount of fuel which is metered into the amount of air flowing through the suction tube, is determined by the pressures prevailing in the fuel reservoir and in the suction tube, and the pressure in the fuel reservoir is changeable by means which are controlled in dependence on engine data, and in particular by the output signal of a measuring probe which detects the composition of the exhaust gas.

In accordance with the present day technical requirements, such fuel-metering systems serve to provide automatically a favorable fuel/air mixture ratio for all operating conditions in a combustion engine, so as to burn up the fuel as completely as possible, and thereby to avoid or greatly diminish the formation of toxic exhaust gases, while ensuring the highest possible performance of the internal combustion engine with the smallest possible consumption of fuel. To this end, the amount of fuel must be metered very precisely in accordance with the particular requirements of each operating condition of the internal combustion engine. Hence, the most favorable mean proportionally value between air amount and fuel amount should be adjustable in dependence on engine data, and in particular on exhaust gas data, which is achieved in the above-described fuelmetering system by changing the pressure in the fuel reservoir.

OBJECTS AND SUMMARY OF THE INVENTION

It is an object of the invention to provide a fuel-metering system of the initially described type, wherein such changes of the pressure prevailing in the fuel reservoir can be achieved by advantageous and inexpensive means.

This object is attained according to the invention, by providing an improved fuel-metering system of the intially described type wherein the air space above the fuel in the fuel reservoir is connected with the zones of the suction tube for the intake of air into the engine, upstream and downstream of a throttle passage provided in the suction tube, by way of air conduits the cross-sectional areas of which are controllable and wherein the control of said cross-sectional areas is carried out in dependence on the output signal of a measuring probe; preferably, the fuel reservoir comprises a chamber provided with means for maintaining a constant fuel level therein, which means are preferably constituted by a float valve. The pressure prevailing in the airspace in this chamber causes a pressure to prevail in the air conduits which depends on the cross-sectional control areas of the latter and which is lower than the pressure prevailing in the suction tube upstream of the throttle passage therein, but which is usually higher than the pressure prevailing downstream of the throttle zone. When in rest position, there should prevail in the airspace a pressure which is about 20% lower than the pressure in the suction tube upstream of the throttle passage. Thereby, it is possible to enrich the air aspirated by the engine with fuel up to a constant 10%, which is a range sufficient for control by a probe.

In an advantageous embodiment of the invention, a change in the cross-sectional area of one of the air conduits results in a change in the opposite sense in the cross-sectional area of the other air conduit. In this embodiment, control of the air conduits takes place preferably by means of a 3 : 2-way solenoid valve, which is preferably a membrane valve in which the membrane is mounted as a movable valve member in the valve housing between the mouths of the air conduits and the product of opening time and cross-sectional area per conduit mouth corresponds to the exciting current for the solenoid. Thereby, the membrane can either adopt varying intermediate positions (proportional type) or alternatingly closes one of the two conduit mouths at a time (integral type).

In another advantageous embodiment of the invention, there is interposed into each of the two air conduits a solenoid valve which is closed in unenergized condition. When communication between the airspace in the fuel reservoir is cyclically established with upstream and downstream conduits by cyclic actuation of the membrane of the solenoid valve, then the airspace, the volume of which above the fuel level is maintained constant by means of the float valve, is subjected to a pressure $p_2$ which is the mean value of pressure $p_1$ prevailing in the upstream conduit and the pressure $p_3$ prevailing in the downstream conduit, and which pressure $p_2$ corresponds to the ratio of the respective lengths of time during which the aforesaid communication is established between the airspace and each of the conduits.

It is preferred to use as a measuring probe an oxygen-detecting probe the body of which consists of an oxygen-ion conducting solid electrolyte, preferably zirconium dioxide, which is vapor-plated on both sides thereof by microporous platinum layers, one of which is exposed to the surrounding air, while the other is exposed to the exhaust gases, in consequence whereof a difference in potential occurs between the platinum layers as soon as the oxygen partial pressure of the outer air differs from that of the exhaust gas. This potential difference changes abruptly in the range in which the air number $\lambda$ is equal to one.

The lower and higher threshold values of the output voltages resulting from the aforesaid potential difference may be used, according to the invention, for the cyclic control each of one solenoid valve, whereby a control in the nature of an integral control is achieved. The use of two solenoid valves, the actuation of which is timed correspondingly, prevents the air conduits from forming a by-pass which could disturb the control effect of the system. However, it is important that the cross-sectional areas of the air conduits are kept small enough to ensure that the amount of air passing through the conduits, as through a by-pass, is less than 5-10% of the amount of air passing through the suction pipe during idling of the engine and therefore remains controllable by the engine and therefore remains controllable by the above-mentioned control probe.

Reference in the specification will be made to the air number, denoted lambda ($\lambda$). This air number $\lambda$ is a measure of the composition of the fuel-air mixture. The number $\lambda$ is proportional to the mass of air and fuel, and the value of this number $\lambda$ is one ($\lambda = 1.0$) if a stoichiometric mixture is present. Under stoichiometric conditions, the mixture has such a composition that, in view of the chemical reactions, all hydrocarbons in the fuel can theoretically combine with the oxygen in the air to provide complete combustion to carbon dioxide and water. In actual practice, even with a stoichiometric mixture, unburned noncombusted hydrocarbons and carbon monoxide are contained in the exhaust gases.

The invention will be better understood and further objects and advantages will become apparent from the ensuing detailed specification of preferred but merely exemplary embodiments taken in conjunction with the drawings.

DESCRIPTION AND OPERATION OF THE EMBODIMENTS

Figure 1:
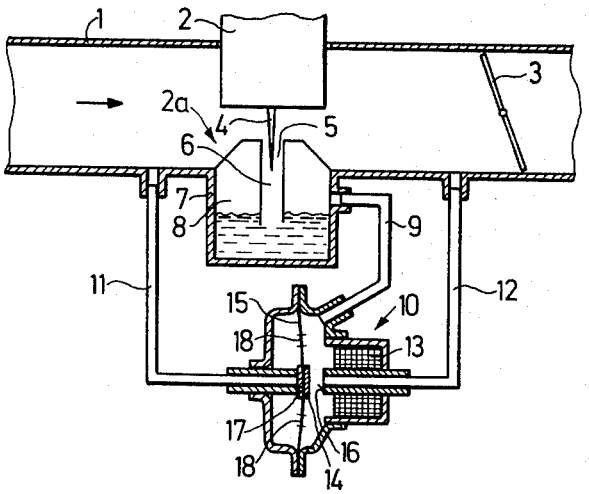
FIG. 1 shows in a schematical view a first embodiment of the fuel-metering system according to the invention provided with a membrane control valve for controlling the air conduits.

An air-measuring device 2 and a randomly adjustable throttle flap 3 are arranged successively in a suction tube 1 for the intake of air. The direction of air flow through suction tube 1 is indicated by an arrow. The air-measuring device 2, which is located upstream of the throttle flap 3, forms a throttle passage 2*a* and controls by means of a needle 4 the cross-sectional area of the fuel-metering orifice 5 of a tube 6 which extends into the fuel in a reservoir 7 with its end away from the fuel-metering outlet 5. Air space 8, which is located above the fuel in reservoir 7, is connected via a line 9 to a valve 10 and can be placed in communication with conduits 11 and/or 12. Conduit 11 leads from valve 10 to a point in the suction tube 1 upstream of the air-measuring device 2, and conduit 12 leads to a point downstream of the air-measuring device 2, but upstream of the throttle flap 3. Valve 10 is devised as a membrane solenoid valve and comprises an armature 14 which is constituted by at least a part or the whole of the membrane 15, and which is actuated by means of a solenoid 13. Membrane 15 extends across the interior of valve 10 and is adapted for closing one or the other of two valve seats 16 and 17 which are located about the open ends of the conduits 11 and 12. In membrane 15 holes 18 are provided through which air can flow without impediment from conduit 11 to conduit 9 when membrane 15 is in a position removed from valve seat 17. As has not been shown in detail in FIG. 1, solenoid 13 is controlled by an amplified current from a measuring probe mounted in the exhaust pipe of the automobile. Depending on the degree of excitation, armature 14, which in idling position obturates valve seat 17, is attracted toward valve seat 16, so that conduit 11 will open, and conduit 12 gradually close unitl, at maximum attraction, membrane 15 will obturate it completely.

The actuation of armature 14 can also be carried out in a cyclic operation, whereby the membrane 15 oscillates between valve seats 16 and 17, alternatingly closing one or the other. In each case, air space 8 in fuel reservoir 7 is subjected more or less to the pressure prevailing in suction tube 1 upstream or downstream of the air-measuring device 2.

Figure 2:
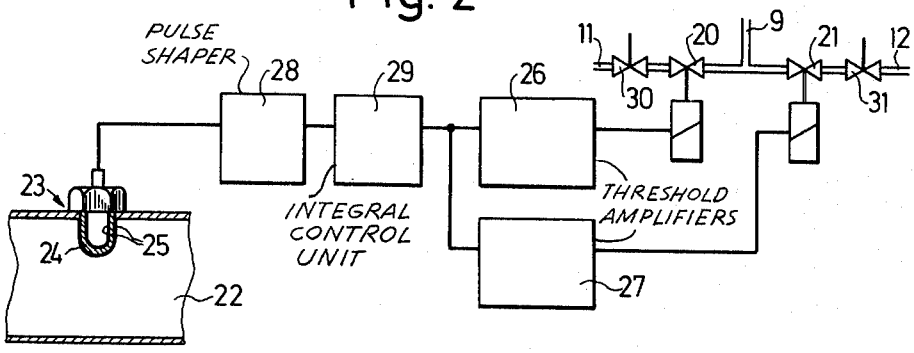
FIG. 2 shows a second embodiment of the fuel-metering system, which is equipped with solenoid valves in the air conduits.

In the embodiment shown in FIG. 2, conduit 9 leading to the fuel reservoir, and the control conduits 11 and 12, which both lead into the suction tube, are the only parts shown of the fuel-metering system illustrated in FIG. 1. In this embodiment, conduits 11 and 12 are controlled by means of solenoid valves 20 and 21, which can be opened and closed alternatively or simultaneously. Each of these valves can be of similar structure as membrane valve 10 shown in FIG. 1, the connection of conduit 9 to the valve being, however, omitted. In the exhaust pipe 22 of the engine, there is mounted a measuring probe 23 which consists of a tube 24 closed at the end thereof protruding into the exhaust pipe; tube 24 is made of a solid electrolyte material, e.g. of sintered zirconium dioxide. Tube 24 is vapor-plated externally and internally with microporous platinum layers 25 which are provided with contactors (not shown) to which an electric potential can be applied. The tube is exposed, on the one hand, to the ambient air and, on the other hand, to the exhaust gases of the automobile. At the high temperatures which prevail in the jet of exhaust gas, the solid electrolyte material is oxygen-ion conducting.

If the oxygen partial pressure in the exhaust gas differs from the oxygen partial pressure in the atmosphere, a potential difference occurs between the two platinum layers, and correspondingly between the contactors (not shown), which potential follows a characteristic curve corresponding to the air number $\lambda$. This potential difference depends logarithmically on the quotient of the oxygen partial pressures prevailing at a given moment on the external and internal sides of the solid electrolyte material. Therefore, the output voltage of the oxygen probe changes abruptly in the range in which the air number is close to or equal to 1.0; for, at air numbers of $\lambda > 1.0$ unburned oxygen will suddenly be present in the exhaust gas. As a result of the strong dependence of the output voltage of the oxygen probe on the air number, the probe is extraordinarily well-suited for controlling the above-mentioned solenoid valves. The oxygen probe voltage is large in the area of $\lambda<1$, and small in the area of $\lambda>1$.

In operating the system according to the invention, only the large and the small voltages, always above or below a predetermined threshold value, are used for the control of the solenoid valves. Thereby, the pressure in air space 8 of the fuel reservoir 7 is adjusted until an air number $\lambda$ being approximately equal to 1 is attained, which was found to be especially favorable and which corresponds to a stoichiometric ratio of the amounts of air and fuel in the mixture. In order to obtain the desired adjustment, solenoid valve 20 is controlled by the low voltages beneath a predetermined lower threshold value, and solenoid valve 21 is controlled by the high voltages above a predetermined upper threshold value. As solenoid valve 20 is actuated to open line 11, pressure in fuel reservoir 7 rises, and the proportion of fuel in the fuel/air mixture increases, while, when solenoid valve 21 is actuated to open line 12, the proportion of fuel in the fuel/air mixture decreases.

Figure 3:
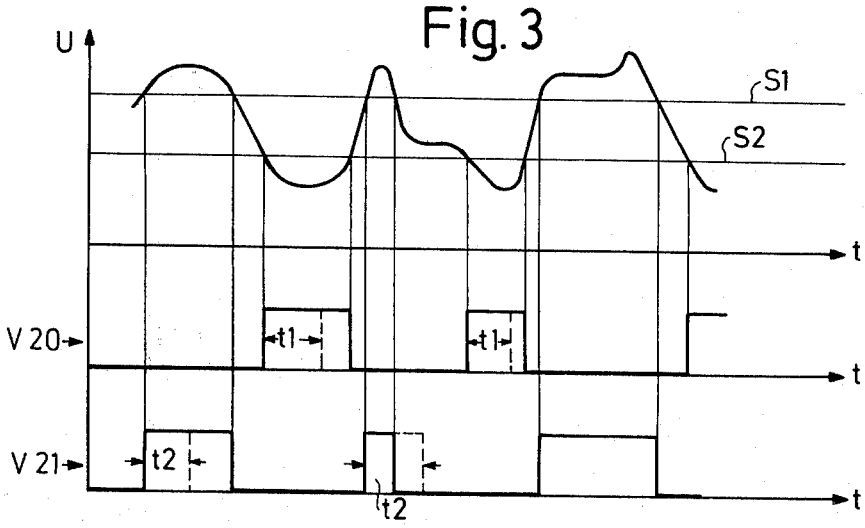
FIGS. 3 to 6 show diagrams illustrating different modes of conduit-control by means of the solenoid valves in the system shown in FIG. 2.

In FIGS. 3 to 6, diagrams are shown, in which the functioning of the system is illustrated more in detail, and in which probe voltages and control voltages, respectively, are shown as functions of time. In FIG. 3, an irregular curve representing changes in the output voltage of the oxygen probe 23 with time is shown in the upper diagram. The horizontal lines S1 and S2 represent predetermined upper and lower threshold values of the output voltage. Only the voltages above or below these threshold value limits are utilized for controlling the solenoid valves in the system. As soon as the output voltage of the probe 23 falls below line S2, only solenoid valve 20 is actuated, as is shown in the next lower graph, designated by V20, while, as soon as the voltage rises above line $S_1$, solenoid valve 21 is actuated as is shown in the lowermost diagram designated by V21. Alternatively, the switch-in times can be of constant duration, as indicated by $t_1$ for valve 20 and by $t_2$ for valve 21. In this case only the switch-on takes place in response to the output voltage of probe 23 dropping below (valve 20) or rising above (valve 21) the respective values $S_2$ and $S_1$, while switch-off takes place automatically, independently of whether the output voltage is still below, or above, the threshold values, after $t_1$ or $t_2$ have elapsed. The switch-off points are indicated by dashed lines in curves V20 and V21 of FIG. 3. This variant can be advantageous whenever quick response to the oxygen probe and at the same time constant actuation times are desired.

Figure 6:
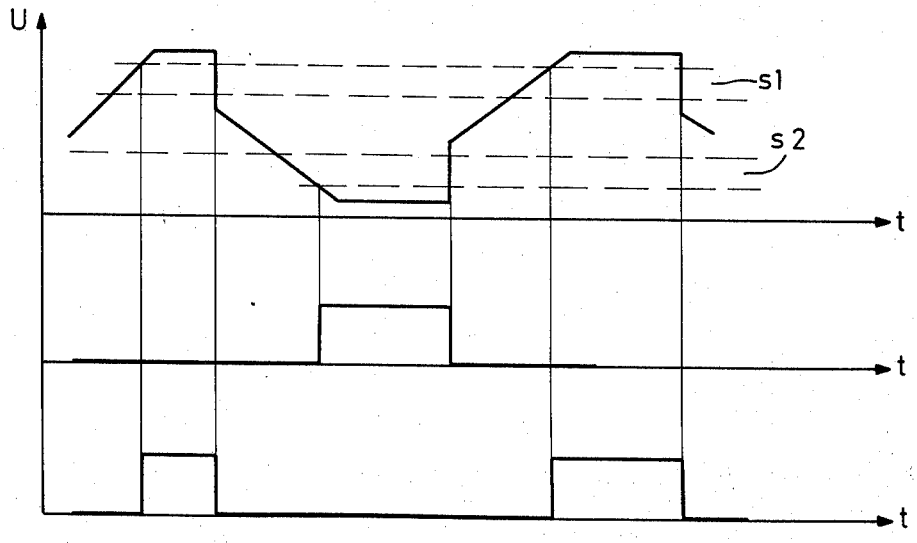

As shown in FIG. 2, conventional threshold amplifiers 26 and 27 which may be constructed substantially the same as the threshold amplifiers (switches) 700 and 710 shown in FIG. 6 of U.S. Pat. No. 3,745,768, are interposed in the switching circuit between probe 23 and solenoid valves 20 and 21; these amplifiers only react to higher or lower voltages above or below the threshold values, and amplify these voltages for the control of the solenoid valves. However, it can also be of advantage to interpose a conventional pulse shaper 28 which may be constructed substantially the same as the threshold amplifiers (switches) shown in FIG. 6 of U.S. Pat. No. 3,745,768, between probe 23 and the threshold value amplifiers 26 and 27, which pulse shaper converts the irregular curve of the probe voltage to a truly rectangular one, which is then divided via a conventional integral control unit 29 including an internal circuit for producing the uppermost wave form of FIG. 6, which may be constructed substantially the same as the active element low pass filter 22, shown in FIG. 9 of U.S. Pat. No. 3,745,768, into evenly rising and evenly falling curve sections, from which the threshold value amplifier then cuts out the upper or lower voltages above or below the respective thresholds.

Figure 4:
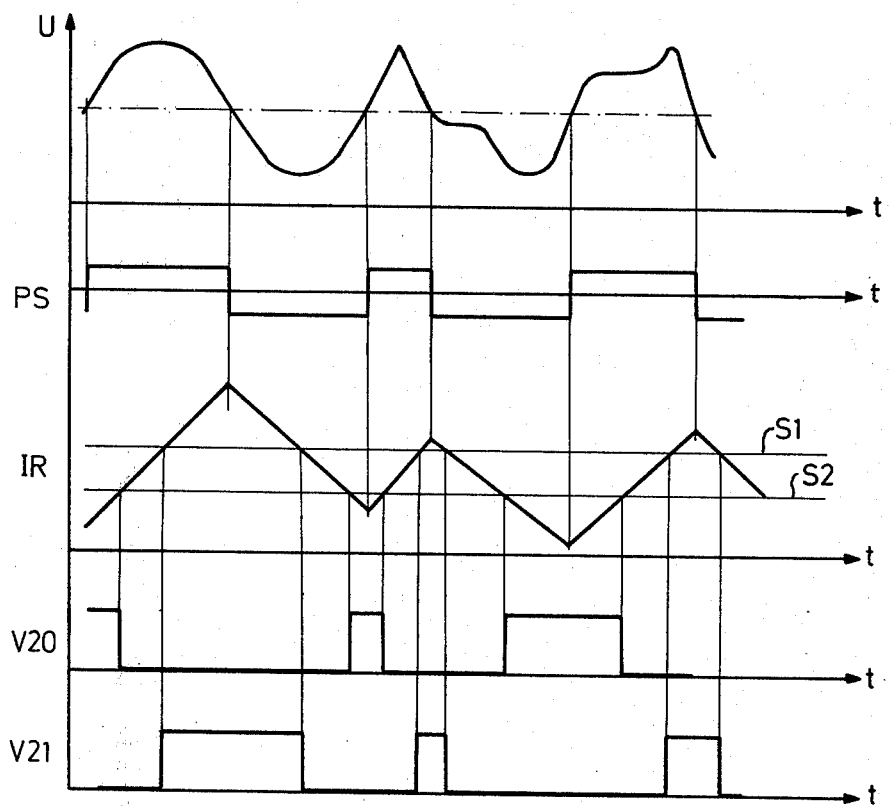

In FIG. 4, the second diagram designated by PS shows the voltage curve resulting from interposition of the pulse shaper 28 and in a third diagram designated by IR the curve derived from the integral regulating means 29. In order to ensure that the threshold voltages coming from the integral control unit are not exceeded too much in the upward or downward direction, it is advisable to impose a voltage limitation by means of one element of the integral control unit, as a result of which a better regulation is achieved, and whereby the solenoid valves 20 and 21 will be switched off directly after the probe voltage changes have passed a maximum or a minimum, respectively.

Figure 5:
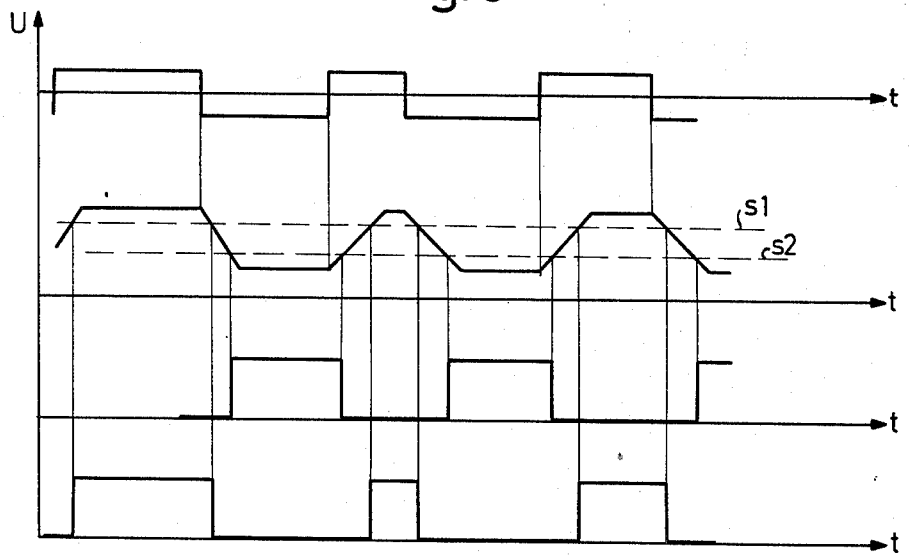

In FIG. 5, the first diagram shows the voltage derived from an integral control unit having a voltage limiting element.

Additionally, the integral control unit may also comprise shaping means for emitting an abrupt voltage change, when the direction of voltage change is reversed, whereby an existing hysteresis of the threshold value amplifier can be overcome. In FIG. 6, the first diagram shows the output voltage of an integral control unit equipped with such pulse shaping means. The pulse shaping means is well known. For example, a proportional-integral acting controller (PI controller) such as is shown on pages 72 and 73 of the textbook "Controller Technology with Electronic Elements" by Xander and Enders, Werner publishers, Düsseldorf 1970, will achieve the necessary pulse shaping.

In the conduit 11 there can be interposed between its opening into the suction tube and the solenoid valve 20 a first additional throttle valve 30 which is adjustable at random, and a second additional throttle valve 31 can be correspondingly interposed in conduit 12.

If the voltage variation with respect to time of the measuring probe 23, as shown in FIGS. 3–6, is considered, then because of the frequency of the engine exhaust, a periodicity is generated which, at high engine rpm represents a high frequency thrust with correspondingly short wave lengths and at low engine rpm represents a low frequency thrust with correspondingly long wave lengths. In a single bed catalyzer disposed after the engine, these alternatingly rich and lean high frequency exhaust thrusts which occur are processed well, whereas slow exhaust thrusts, i.e. long wave lengths cannot be processed as well.

Figure 7:
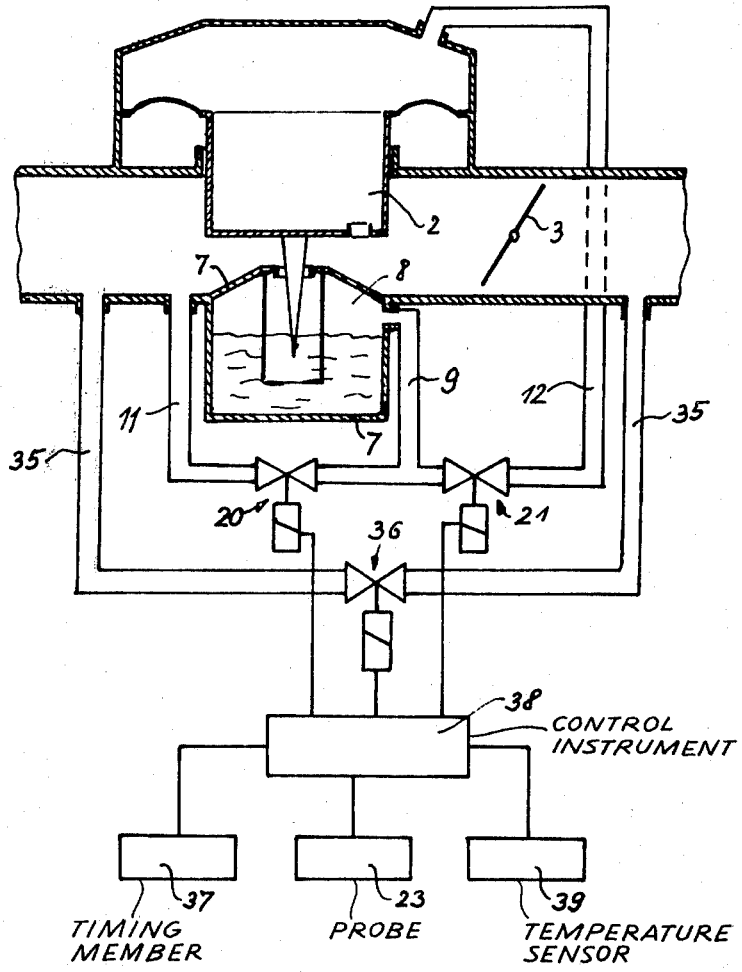
FIG. 7 shows in a schematic view a further embodiment of the fuel-metering system according to the invention.

In order to reduce the occurrence of these low frequency thrusts and corresponding long wave lengths, which are caused by carburetor dead time in connection with the engine suction tube and exhaust system, according to the invention as is shown in FIG. 7, an air bypass regulating structure is provided. According to this structure the section of the suction tube 1 lying upstream of the air-measuring device 2 is connected to the section of the suction tube 1 lying downstream of the throttle flap 3 by a bypass line 35 controlled by a solenoid valve 36. The solenoid valve 36, in turn, can be preferably controlled by the measuring probe 23 through the utilization of the identical electronic device already present for controlling the pressure in the fuel reservoir 7. This control reduces the dead time of the entire regulating system. It reacts correspondingly rapidly and has the desired consequence of rapidly alternating between rich and lean conditions of the exhaust gas. The air bypass regulating structure, in a first approximation, affects the air number $\lambda$ only additively, i.e. during low throughputs (long wave lengths) its influence is large; whereas during large throughputs (high frequency) its influence is small. For this reason it compensates for the cited disadvantages.

The solenoid valve 36 can operate in analog or digital fashion and in practice would be made to conform to the method of operation of the valves 20 and 21. The solenoid valve 36 could also be activated in dependence on the rpm or the ignition frequency of the engine, instead of being controlled by the oxygen measuring probe 23. In that case the additive air bypass regulating structure would acquire an rpm-dependent part.

A low dependent part could be acquired if a suction tube pressure control throttle were disposed in the bypass.

In the control of the solenoid valves 20 and 21 described above, the frequency of the engine exhaust brings about a disadvantage in that the opening periods of the solenoid valves are unequally long because of the differing wave lengths, so that a direct influence of the rpm and therefore also of the load on the control period is present. The mixture throughput of an engine varies roughly in the proportion of 1:30 to 1:40, so that different time durations elapse until the effect of the described control actions is properly indicated by the measuring probe 23.

It is therfore intended, according to one embodiment of the invention, to eliminate the rpm-dependent part, which results from the running and dead times of the mixture throughput, so that only a variation in the proportion of approximately 1:5 to 1:6 needs to be considered in the determination of the time dependence of the control installation. According to the invention, therefore, the opening time of the magnetic solenoid valves 20 and 21 is controlled in dependence on the ignition time; and the opening time of the particular valve is controlled by the probe voltage sequence. An electrical circuit which can be used for such a control is shown, for example, in German DOS 2,202,614 (laid open application) which corresponds to commonly assigned U.S. Pat. application Ser. No. 259,157 now U.S. Pat. No. 3,874,171. In that circuit an ignition distributor provides under certain circumstances and via a delay member the switch-on pulse for one of the valves 20 or 21, and the opening time of that valve is then further controlled in dependence on the probe voltage. In this case the second valve is opened when the first valve has closed. It is more advantageous if the total opening time is held constant in order to guard against any surges during the pressure-buildup in the air space 8 of the fuel reservoir 7. Since the valves naturally have assigned to them an amplitude different from that wave belonging to the motor suction frequency, the control sequence of the valves can be changed, i.e. instead of following the control sequence of the valves 20, 21 per wave length, the sequence could also be 21, 20. By such a change of the control sequence, corrections would be possible. In any case the switch-on by a conventional timing member 37 which may be constructed substantially the same as the timing arrangement known from U.S. Pat. No. 3,483,851, (ignition distributor) will be placed in a middle portion of the engine suction stroke in order to obtain as high an effective pressure as possible for the pressure control of the fuel reservoir 7 and where this pressure will be free of influences due to engine valve overlap. The electronic control instrument designated with numeral 38 in FIG. 7 will then contain control elements as they were described for FIG. 2 and as they were especially described in the aforenoted German Published Application stated differently, the electronic control instrument 38 can be considered to be constructed by a combination of the individual circuit elements designated by the numerals 26, 27, 28 and 29 in FIG. 2 of the present application.

According to a further embodiment of the invention, the pressure change in the fuel reservoir 7 and therefore the fuel-air mixture change provided to the engine can be used in order to achieve an enrichment of this mixture in a cold internal combustion engine. For this purpose a conventional temperature sensor 39 which may be constructed substantially the same as the thermoelement 80 shown in FIG. 9 of U.S. Pat. No. 3,745,768, measures the engine temperature in order to achieve the fuel-air mixture change by changing the control times of the valve 20 or 21. Circuits which serve this purpose are shown in German Patent No. 1,526,506, which corresponds to U.S. Pat. No. 3,483,851. The corresponding circuit could also be arranged within the electronic control instrument 38.

The entire system according to the invention, i.e. the air pressure regulation in the fuel reservoir 7 in dependence on the output voltage of a measuring probe 23 located in the exhaust, serves for the very close regulation of the fuel-air mixture condition which is provided to the engine. It is not so much intended for coarse variations of the fuel-air mixture condition, because the pressures available for this purpose, as well as the opening times, are too small. In this respect it is to be regarded in the first instance as a fine control for the warm-up control as well. The coarse warm-up control would occur customarily as before by means of a bimetallic or other thermo element, for example, up to a temperature of 20° C. The exhaust gas probe-dependent control can possibly occur only after the termination of the warm-up control.

What is claimed is:

1. A fuel-metering system adapted for attachment to an air-intake suction tube, having a throttle passage therein, of an internal combustion engine having an exhaust for waste gases, which system comprises:

a. a fuel reservoir adapted for having an airspace above the fuel therein;

b. means for measuring the air pressures in said airspace and said suction tube and for metering fuel amounts to be introduced into given amounts of air flowing through said suction tube, in dependence on said air pressures, and c. means for varying the air pressures prevailing in said airspace, in dependence on characteristic engine data, which air pressure-varying means comprise:

i. first conduit means for connecting said airspace with said suction tube upstream of the throttle passage of the latter, ii. second conduit means for connecting said airspace with said suction tube downstream of said throttle passage, iii. an output signal-emitting measuring probe for detecting the composition of the exhaust waste gases of said internal combustion engine, and iv. valve means for controlling the cross-sectional areas of said first and second conduit means in dependence on output signals emitted by said measuring probe, by increasing one of said cross-sectional areas and correspondingly decreasing automatically the other cross-sectional area, thereby varying the pressure in said airspace.

2. A fuel-metering system as described in claim 1, wherein said valve means comprise a 3:2-way valve.

3. A fuel-metering system as described in claim 1, wherein said valve means comprise at least one membrane valve with the interior of which said first and second conduit means communicate, said membrane valve comprising a movable membrane interposed between the openings of said first and second conduit means in the membrane valve interior, and solenoid means connected to said probe to be cyclically actuated digitally, depending on the exciting current emitted by said probe, whereby said membrane is so attracted by said solenoid means that the opening time and cross-sectional area of each conduit opening corresponds to the intensity of said exciting current.

4. A fuel-metering system as described in claim 3, wherein said valve means include means for obturating said opening of said first conduit means when said membrane is unattracted by said solenoid means.

5. A fuel-metering system as described in claim 3, wherein said valve means includes adjustment means for effecting, upon said solenoid means being unenergized, the air pressure in said airspace to be about 20% lower than the air pressure in said suction tube upstream of said throttle passage.

6. A fuel-metering system as described in claim 3, wherein said valve means comprise a first and a second solenoid valve obturating respectively with said first and second conduit means and obtrating the latter when unenergized.

7. A fuel-metering system as described in claim 6, wherein said fuel reservoir comprises a float valve for maintaining the fuel level in said reservoir, and together therewith the volume of said airspace constant, and wherein said solenoid valves cyclically establish communication between said airspace and said first and second conduit means, respectively, thereby subjecting the airspace to a mean pressure $p_2$ being a mean value of pressure $p_1$ prevailing in said first conduit means and pressure $p_3$ prevailing in said second conduit means, and corresponding to the ratio of the respective times of communication of said airspace with said two conduits.

8. A fuel-metering system as defined in claim 6, further comprising ignition timing means, wherein the opening time of said first and second solenoid valves is controlled in dependence on said ignition timing means, and wherein the opening time is determined by the voltage sequence of said measuring probe.

9. A fuel-metering system as described in claim 8, wherein said first and second solenoid valves are controlled within a middle portion of the engine suction strokes and displaced with respect to the ignition timing, in order to obtain as high an effective pressure as possible which is free of valve overlap influences.

10. A fuel-metering system as described in claim 8, wherein the control sequence for said first and second solenoid valves per cycle is changeable between two subsequent ignition times.

11. A fuel-metering system as described in claim 8, wherein said timing means and said probe are coupled to said first and second solenoid valves via control circuit means for effecting that the sum of the opening times of said first and second solenoid valves per cycle is constant.

12. A fuel-metering system as described in claim 8, wherein said timing means and said probe are coupled to said first and second solenoid valves via control circuit means for effecting that the opening time of each of said first and second solenoid valves is constant at least within a particular rpm range.

13. A fuel-metering system as described in claim 1, wherein said valve means comprise at least one membrane valve with the interior of which said first and second conduit means communicate, said membrane valve comprising a movable membrane interposed between the openings of said first and second conduit means in the membrane valve interior, and solenoid means connected to said probe to be cyclically actuated analogously, depending on the exciting current emitted by said probe, whereby said membrane is so attracted by said solenoid means that the opening time and cross-sectional area of each conduit opening corresponds to the intensity of said exciting current.

14. A fuel-metering system adapted for attachment to an air-intake suction tube, having a throttle passage therein, of an internal combustion engine having an exhaust for waste gases, which system comprises:

a. a fuel reservoir adapted for having an airspace above the fuel therein;

b. means for measuring the air pressures in said airspace and said suction tube and for metering fuel amounts to be introduced into given amounts of air flowing through said suction tube, in dependence on said air pressures;

c. means for varying the air pressures prevailing in said air space, in dependence on characteristic engine data, which air pressure-varying means comprise:

i. first conduit means for connecting said airspace with said suction tube upstream of the throttle passage of the latter, ii. second conduit means for connecting said airspace with said suction tube downstream of said throttle passage, iii. an output signal-emitting measuring probe for detecting the composition of the exhaust waste gases of said internal combustion engine wherein said measuring probe is an oxygen detecting probe comprising a probe body of oxygen ion-conducting solid electrolyte coated on the inside and outside thereof with microporous platinum layers, one of which layers is in contact with the outside air, and the other is in contact with exhaust gases from said internal combustion engine, whereby a potential difference is generated by any difference between the oxygen partial pressures in said outside air and exhaust gases, and whereby said potential difference changes abruptly in the range of the air number being equal to 1, and iv. valve means for controlling the cross-sectional areas of said first and second conduit means in dependence on output signals emitted by said measuring probe, said valve means comprising:

i. a first solenoid valve interposed in said first conduit means;

ii. a second solenoid valve interposed in said second conduit means; and iii. means adapted for cyclically applying the output voltages resulting from said potential difference and being above or below predetermined threshold values to said first and second solenoid valve, respectively, thereby attaining an integral type of control of said solenoid valves;

d. ignition timing means; and e. engine temperature sensing means, wherein said ignition timing means and engine temperature sensing means produce, along with said measuring probe, electrical signals which are supplied to said voltage-applying means for controlling said first and second solenoid valves, wherein the opening time of said first and second solenoid valves is controlled in dependence on said ignition timing means, and wherein the opening time is determined by the voltage sequence of said measuring probe.

15. A fuel-metering system as described in claim 14, wherein said timing means, said temperature sensing means and said probe are coupled to said first and second solenoid valves via control circuit means for effecting that said first and second solenoid valves are controlled within a middle portion of the engine suction strokes and displaced with respect to the ignition timing, in order to obtain as high an effective pressure as possible which is free of valve overlap influences.

16. A fuel-metering system as described in claim 14, wherein said timing means, said temperature sensing means and said probe are coupled to said first and second solenoid valves via control circuit means for effecting that the control sequence for said first and second solenoid valves per cycle is changeable between two subsequent ignition times.

17. A fuel-metering system as described in claim 14, wherein said timing means, said temperature sensing means and said probe are coupled to said first and second solenoid valves via control circuit means for effecting that the sum of the opening times of said first and second solenoid valves per cycle is constant.

18. A fuel-metering system as described in claim 14, wherein said timing means, said temperature sensing means and said probe are coupled to said first and second solenoid valves via control circuit means for effecting that the opening time of each of said first and second solenoid valves is constant at least within a particular rpm range.

19. A fuel-metering system as described in claim 14, wherein said engine temperature sensing means is coupled to said first and second valves via control circuit means for effecting that output signals therefrom serve as a fine control during engine warm-up.

20. A fuel-metering system adapted for attachment to an air-intake suction tube, having a throttle passage therein, of an internal combustion engine having an exhaust for waste gases, which system comprises:

a. a fuel reservoir adapted for having an airspace above the fuel therein;

b. means for measuring the air pressures in said airspace and said suction tube and for metering fuel amounts to be introduced into given amounts of air flowing through said suction tube, in dependence on said air pressures, and c. means for varying the air pressures prevailing in said airspace, in dependence on characteristic engine data, which air pressure-varying means comprise:

i. first conduit means for connecting said airspace with said suction tube upstream of the throttle ii. second conduit means for connecting said airspace with said suction tube downstream of said throttle passage, iii. an output signal-emitting measuring probe for detecting the composition of the exhaust waste gases of said internal combustion engine wherein said measuring probe is an oxygen detecting probe comprising a probe body of oxygen ion-conducting solid electrolyte coated on the inside and outside thereof with microporous platinum layers, one of which layers is in contact with the outside air, and the other is in contact with exhaust gases from said internal combustion engine, whereby a potential difference is generated by any difference between the oxygen partial pressures in said outside air and exhaust gases, and iv. valve means for controlling the cross-sectional areas of said first and second conduit means in dependence on output signals emitted by said measuring probe, said valve means comprising:

i. a first solenoid valve interposed in said first conduit means;

ii. a second solenoid valve interposed in said second conduit means; and iii. means adapted for cyclically applying the output voltages resulting from said potential difference and being above or below predetermined threshold values to said first and second solenoid valve, respectively, thereby attaining an integral type of control of said solenoid valves;

d. ignition timing means; and e. engine temperature sensing means, wherein said ignition timing means and said engine temperature sensing means produce, along with said measuring probe, electrical signals which are supplied to said voltage-applying means for controlling said first and second solenoid valves, wherein the output signals from said engine temperature sensing means serve as a fine control during engine warm-up.

* * * * *